US008522741B2

(12) United States Patent
Matsuda et al.

(10) Patent No.: US 8,522,741 B2
(45) Date of Patent: Sep. 3, 2013

(54) AIR-INTAKE DUCT AND AIR-INTAKE STRUCTURE

(75) Inventors: Yoshiharu Matsuda, Akashi (JP); Takafumi Matsumoto, Himeji (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 234 days.

(21) Appl. No.: 12/973,711

(22) Filed: Dec. 20, 2010

(65) Prior Publication Data

US 2011/0155086 A1 Jun. 30, 2011

(30) Foreign Application Priority Data

Dec. 29, 2009 (JP) ..... 2009-299199

(51) Int. Cl.
*F02M 35/10* (2006.01)

(52) U.S. Cl.
USPC ..... 123/184.24; 123/184.21; 123/184.27; 123/184.34

(58) Field of Classification Search
USPC ..... 123/184.21, 184.24, 184.27, 184.34, 123/184.61
See application file for complete search history.

(56) References Cited

U.S. PATENT DOCUMENTS 5,542,385 A * 8/1996 Kim ..... 123/184.52
5,797,380 A * 8/1998 Tada et al. ..... 123/572
5,899,196 A * 5/1999 Chite ..... 123/556
5,927,254 A * 7/1999 Ino et al. ..... 123/470
6,032,634 A * 3/2000 Minegishi et al. ..... 123/184.55
6,092,498 A * 7/2000 Lohr et al. ..... 123/90.38
6,209,528 B1 * 4/2001 Kondo ..... 123/565
6,543,412 B2 * 4/2003 Amou et al. ..... 123/337
6,684,840 B1 * 2/2004 Kuwano et al. ..... 123/184.21
7,028,669 B2 * 4/2006 Nagashii et al. ..... 123/470
7,131,416 B2 * 11/2006 Sasaki et al. ..... 123/184.36
7,287,502 B2 * 10/2007 Hattori ..... 123/184.21
2001/0027776 A1 * 10/2001 Amou et al. ..... 123/478
2002/0129780 A1 * 9/2002 Nohara et al. ..... 123/90.16

FOREIGN PATENT DOCUMENTS

JP 2006-090298 A 4/2006

* cited by examiner

*Primary Examiner* — Noah Kamen
*Assistant Examiner* — Long T Tran
(74) *Attorney, Agent, or Firm* — Alleman Hall McCoy Russell & Tuttle LLP

(57) ABSTRACT

An air-intake duct, which is disposed between an air outlet of an air cleaner box constituting an air cleaner and an air inlet of a throttle body constituting a throttle device, is configured to guide air cleaned by the air cleaner to the throttle device. The air-intake duct includes a tubular coupling member including an upstream coupling portion coupled in an air tight manner to the air outlet of the air cleaner box and a downstream coupling portion air-tightly coupled to the air inlet of the throttle body, the coupling member being entirely formed of an elastic rubber material. The air-intake duct also includes an air guide member including a first air inlet configured to take in air therethrough from inside the air cleaner box, a first air outlet configured to discharge the air therethrough toward the throttle body, and a fitting portion fitted to the coupling member.

2 Claims, 9 Drawing Sheets

AIR-INTAKE DUCT AND AIR-INTAKE STRUCTURE

CROSS-REFERENCE TO RELATED APPLICATION

The present application claims priority to Japanese Patent Application No. 2009-29919 filed on Dec. 29, 2009, which is hereby incorporated by reference in its entirety for all purposes.

BACKGROUND ART

1. Field of the Invention

The present invention relates to an air-intake duct and an air-intake structure for guiding air to a throttle device coupled to an engine.

2. Description of the Related Art

An engine mounted in a motorcycle and other vehicles includes a cylinder head having a combustion chamber. An air-intake structure forming an air-intake passage is coupled to an intake port of the combustion chamber to guide air and fuel to the combustion chamber. The air-intake structure typically includes an air cleaner box of an air cleaner, an air-intake duct, and a throttle body of a throttle device which are coupled to each other in this order from an upstream side in an air flow direction. The throttle body is provided with an injector for injecting a fuel.

Japanese Laid-Open Patent Application Publication No. 2006-90298 discloses a double-injector air-intake structure applied to a high power engine, in which an injector (upstream injector) is provided inside an air cleaner box in addition to the above injector (downstream injector), and an air inlet of an air-intake duct is disposed to face an injection port of the upstream injector so that air cleaned by the air cleaner and fuel injected from the upstream injector are efficiently guided to the throttle device.

The air-intake duct forming the double-injector air-intake structure has a coupling function for coupling in an air tight manner the air cleaner box to the throttle body and an air guiding function for guiding the cleaned air and the fuel to the throttle device. In the conventional air-intake structure disclosed in the above Publication, a coupling member for performing the coupling function and an air guiding member for performing the air guiding function are integrally formed of the same material, and therefore it is difficult to perform these functions in a well-balanced manner.

For example, the coupling member is desirably formed of an elastic rubber material to ensure air-tightness. If both the coupling member and the air guiding member are formed of the elastic rubber material, it is necessary to increase the wall thickness of the air guiding member to maintain its shape. This narrows an air passage and degrades the air guiding function. In addition, the weight of the air-intake duct increases because of an increase in a wall thickness of the air guiding member, thereby resulting in a reduced fuel efficiency. On the other hand, if both the coupling member and the air guiding member are formed of a material (synthetic resin, metal, etc) other than the elastic rubber material, then a seal member such as an O-ring is needed to ensure air-tightness in the coupling member. This reduces a mounting efficiency of the air-intake duct.

If the coupling member and the air guiding member are molded integrally using a die, the entire air-intake duct has a complex shape. For this reason, undercut frequently occurs, design flexibility is lessened, and manufacturing cost increases because of complexity of the die.

The air-intake performance of the air-intake passage can be controlled precisely by changing the length of the air guiding member. To this end, in the conventional structure, it is necessary to replace the entire air-intake duct. This task is burdensome. Therefore, it is not easy to control the air-intake performance of the air-intake passage.

SUMMARY OF THE INVENTION

The present invention addresses the above described conditions, and an object of the present invention is to provide an air-intake duct and air-intake structure which can perform a coupling function and an air guiding function in a well-balanced manner, can reduce weight to improve fuel efficiency, can improve design flexibility, can be manufactured without a cost increase, and can easily control an air-intake performance of an air-intake passage.

According to one aspect of the present invention, there is provided an air-intake duct which is disposed between an air outlet of an air cleaner box constituting an air cleaner and an air inlet of a throttle body constituting a throttle device and configured to guide air cleaned by the air cleaner to the throttle device, comprising: a tubular coupling member including an upstream coupling portion coupled in an air tight manner to the air outlet of the air cleaner box and a downstream coupling portion coupled in an air tight manner to the air inlet of the throttle body, the coupling member being entirely formed of an elastic rubber material; and an air guide member including a first air inlet configured to take in air therethrough from inside the air cleaner box, a first air outlet configured to discharge the air therethrough toward the throttle body, and a fitting portion fitted to the coupling member.

In accordance with this configuration, the coupling member and the air guide member can be manufactured individually as separate members. Therefore, the entire coupling member is formed of an elastic rubber material, and the entire or a part of the air guide member is formed to have a small wall thickness using a material other than the elastic rubber material, the material being lightweight and having a high stiffness, which makes it possible to maintain a shape of the air guide member, as compared to the elastic rubber material. As a result, the coupling member and the air guide member can be designed flexibly so that they can perform their respective functions in a well-balanced manner. In addition, fuel efficiency can be improved because of the reduced weight and a manufacturing cost of the air-intake duct can be reduced.

In addition, since the fitting portion of the air guide member is fitted to the coupling member to form the air-intake duct, only the air guide member can be changed easily without detaching the coupling member. Thus, air-intake performance of the air-intake passage can be controlled easily merely by changing the air guide member into one with a different length.

The air guide member may be formed of synthetic resin or metal.

In this configuration, the air guide member can be formed to have a small wall thickness and maintain its shape using synthetic resin or metal.

The air-intake duct may further comprise a second air inlet provided to open in a direction different from a direction in which the first air inlet opens and configured to take in the air therethrough from inside the air cleaner box, and a second air outlet configured to discharge the air therethrough toward the throttle body.

In accordance with this configuration, the air can be taken in from the inside of the air cleaner box through both the first air inlet and the second air inlet.

A portion of a downstream edge of the air guide member may be positioned inside the air cleaner box such that the portion of the downstream edge is apart from an upstream edge of the coupling member, and the second air inlet may be provided between the portion of the downstream edge and the upstream edge of the coupling member.

In accordance with this configuration, since the portion of the downstream edge of the air guide member and the upstream edge of the coupling member form together the second air inlet, it is not necessary to form the second air inlet only in one of the air guide member and the coupling member. As a result, the structure of the air guide member and the structure of the coupling member can be simplified, and the air-intake duct can be manufactured without a cost increase.

The second air inlet may be a hole formed on a side surface of the air guide member.

In accordance with this configuration, since the second air inlet is formed by the hole formed on the side surface of the air guide member, the opening area of the second air inlet can be determined correctly.

The coupling member may have a stepped portion on at least a portion of an inner peripheral surface thereof, and at least a portion of a downstream end surface of the air guide member being engageable with the stepped portion. The fitting portion may be fitted to a portion of the inner peripheral surface of the coupling member which is located upstream of the stepped portion. A portion of the inner peripheral surface of the coupling member which is located downstream of the stepped portion may be continuous with an inner surface of the air guide member without a level difference.

In accordance with this configuration, the air guide member can be positioned correctly with respect to the coupling member by engaging at least the portion of the downstream end surface of the air guide member with the stepped portion. In addition, since the portion of the inner peripheral surface of the coupling member which is located downstream of the stepped portion is continuous with the inner surface of the air guide member without a level difference, the air can flow through these regions smoothly.

The coupling member may include an air guide portion configured to guide the air from inside the air cleaner box to the second air inlet.

In accordance with this configuration, the air guide portion provided at the coupling member can efficiently guide the air from the inside of the air cleaner box to the second air inlet.

According to another aspect of the present invention, there is provided an air-intake structure including an air-intake duct structure which is disposed between an air outlet of an air cleaner box constituting an air cleaner and an air inlet of a throttle body constituting a throttle body and configured to guide air cleaned by the air cleaner to the throttle device, the air-intake duct structure comprising: a tubular coupling member including an upstream coupling portion coupled in an air tight manner to the air outlet of the air cleaner box and a downstream coupling portion coupled in an air tight manner to the air inlet of the throttle body, the coupling member being entirely formed of an elastic rubber material; and an air guide member including a first air inlet configured to take in air therethrough from inside the air cleaner box, a first air outlet configured to discharge the air therethrough toward the throttle body, and a fitting portion coupled to the coupling member, wherein an injector is disposed inside the air cleaner box and includes an injection port configured to inject a fuel therethrough, and the first air inlet is positioned to face the injection port.

This configuration relates to the air-intake structure including the air-intake duct structure using the air-intake duct, the injection port of the injector communicates with the inner space of the air cleaner box, and the first air inlet of the air guide member is positioned to face the injection port. Therefore, the air cleaned by the air cleaner and the fuel injected through the injection port of the injector can be guided efficiently toward the throttle device.

The air-intake duct structure may include a second air inlet which is provided to open in a direction different from a direction in which the first air inlet opens and configured to take in the air therethrough from inside the air cleaner box, and a second air outlet configured to discharge the air therethrough toward the throttle body.

In accordance with this configuration, the air can be taken in from inside the air cleaner box through both the first air inlet and the second air inlet.

The air-intake duct structure may include an air guide unit configured by coupling a plurality of air guide members to each other and at least one fastening member configured to fasten the air guide unit to the air cleaner box.

In accordance with this configuration, since each of the plurality of air guide members constituting the air guide unit can be reinforced by the other air guide member, the shape of the air guide member can be maintained invariably. In addition, since the air guide unit including the plurality of air guide members can be fastened to the air cleaner box, as one component, higher fastening stiffness can be obtained with fewer fastener members as compared to a configuration in which the plurality of air guide members are fastened individually to the air cleaner box.

The above and further objects and features of the invention will more fully be apparent from the following detailed description with reference to the accompanying drawings.

DETAILED DESCRIPTION OF THE PREFERRED EMBODIMENTS

Hereinafter, embodiments of the present invention will be described with reference to the drawings. The stated directions are referenced from the perspective of a driver straddling a motorcycle, unless otherwise explicitly noted.

Embodiment 1

[Construction of Motorcycle]

Figure 1:
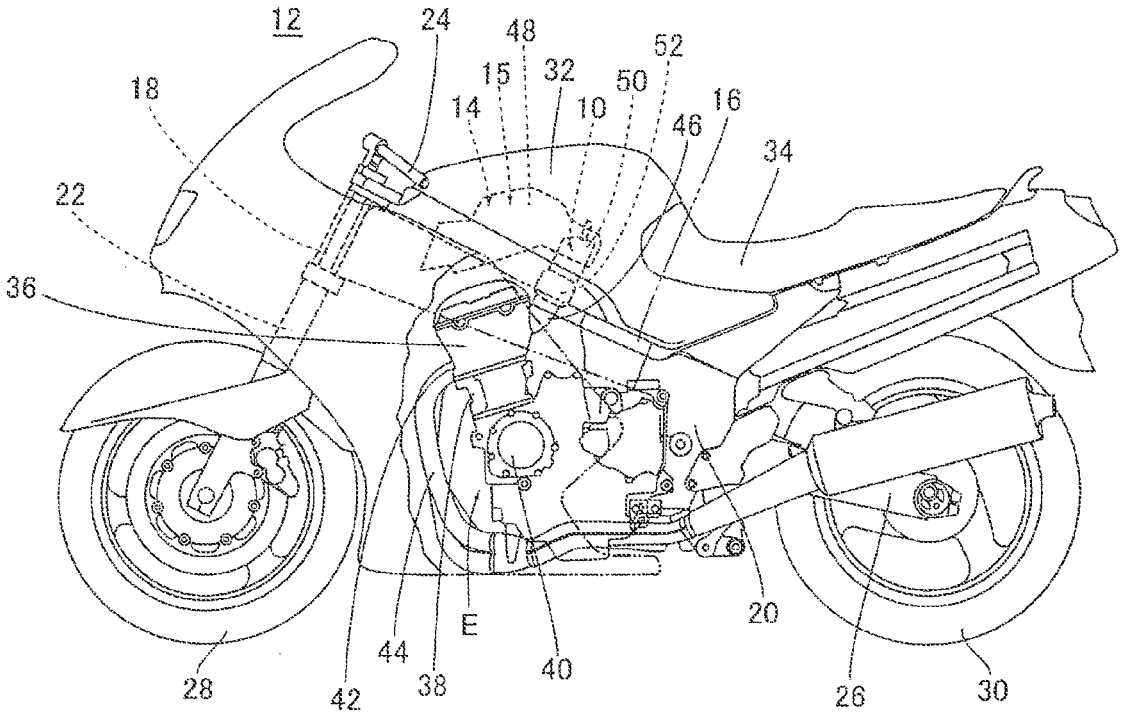
FIG. 1 is a left side view of a construction of an entire motorcycle including an air-intake structure including an air-intake duct structure according to Embodiment 1.
Figure 2:
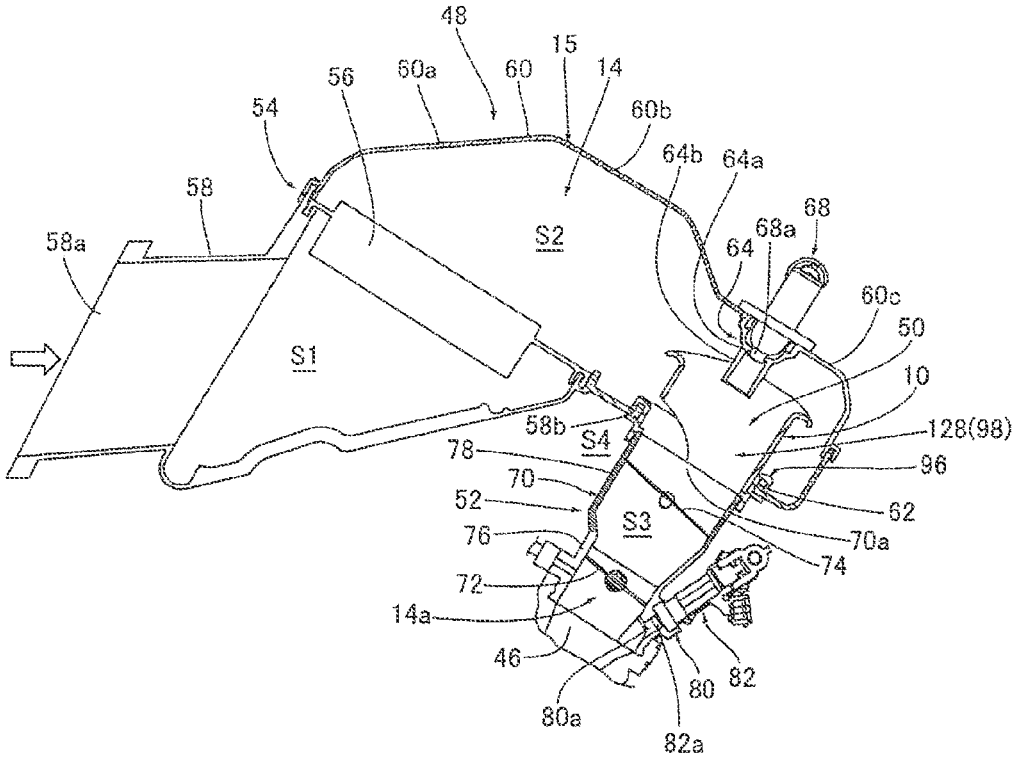
FIG. 2 is a cross-sectional view showing a configuration of the air-intake structure according to Embodiment 1.

FIG. 1 is a left side view of a construction of an entire motorcycle 12 including an air-intake structure 15 including an air-intake duct structure 10 according to Embodiment 1. FIG. 2 is a cross-sectional view showing a configuration of the air-intake structure 15.

Referring now to FIG. 1, the motorcycle 12 includes a main frame member 16, a head pipe 18 provided at the front portion of the main frame member 16 and a pair of right and left pivot frame members 20 provided at the rear portion of the main frame member 16. A steering shaft (not shown) is rotatably inserted into the head pipe 18. A front fork 22 and a steering handle 24 are attached to the steering shaft. A pair of right and left swing arms 26 are attached to the pivot frame members 20, respectively. A front wheel 28 is mounted to the lower end portion of the front fork 22. A rear wheel 30 is mounted to the rear end portions of the swing arms 26. A fuel tank 32 and a seat 34 are arranged at the upper portion of the main frame member 16 such that the fuel tank 32 is disposed forward relative to the seat 34. An engine E is mounted at the center portion in a space defined by the main frame 16 below the fuel tank 32.

As shown in FIG. 1, the engine E includes a cylinder head 36, a cylinder block 38, and a crankcase 40. Although not shown, a combustion chamber is formed inside the cylinder head 36. A cylinder and a piston are accommodated in the cylinder block 38. A crankshaft driven to rotate by the piston is accommodated in the crankcase 40. In this embodiment, the engine E is an inline four-cycle four-cylinder reciprocating engine. The four cylinders and four combustion chambers are arranged in a rightward and leftward direction, i.e., a width direction of the motorcycle 12. Exhaust pipes 44 are respectively coupled to exhaust ports 42 respectively corresponding to the four combustion chambers and configured to exhaust air therethrough. An air-intake structure 15 constituting an air-intake passage 14 is coupled to intake ports 46 respectively corresponding to the four combustion chambers to suction an air-fuel mixture containing air and fuel.

Figure 3:
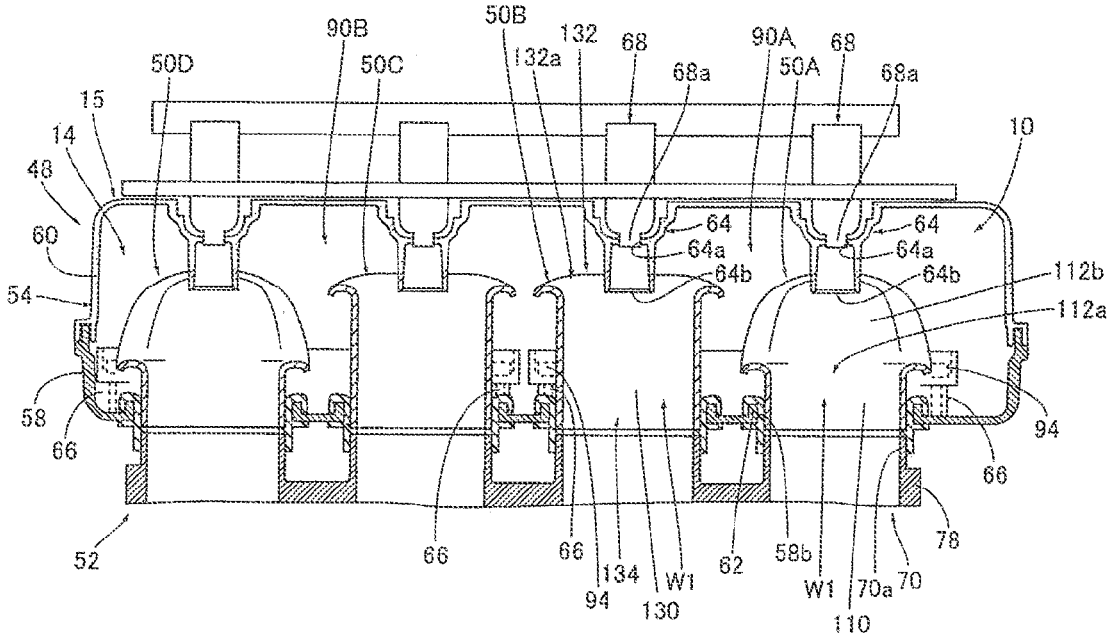
FIG. 3 is a cross-sectional view showing the air-intake structure according to Embodiment 1.

As shown in FIGS. 1 and 2, the air-intake structure 15 includes an air cleaner box 54 of an air cleaner 48 positioned between the engine E and the fuel tank 32, four air-intake ducts 50 (air-intake ducts 50A, 50B, 50C and 50D), and a throttle body 70 of a throttle device 52 disposed behind the engine E and below the air cleaner 48, which are coupled to each other in this order from an upstream side in the air flow direction. As shown in FIG. 3, a portion of the air-intake structure 15 which is located downstream of the air cleaner 48 branches to form four branch passages, illustrated at 14*a* in FIG. 2, respectively corresponding to the four combustion chambers and the four cylinders.

[Configuration of Air Cleaner]

As shown in FIG. 2, the air cleaner 48 is configured to take in air from outside by utilizing a ram pressure, clean the air and distribute the air to the four branch passages 14*a*, and includes the air cleaner box 54 constituting a part of the air-intake structure 15 and an air cleaner element 56 for cleaning the air flowing through the inside of the air cleaner box 54.

The air cleaner box 54 includes a lower case 58 formed of synthetic resin and an upper case 60 formed of synthetic resin. The lower case 58 and the upper case 60 are joined to each other to form the air cleaner box 54 of a box shape. The air cleaner element 56 is disposed in the vicinity of a boundary between a space (inner space: dirty side) S1 formed inside the lower case 58 and a space (inner space: clean side) S2 formed inside the upper case 60.

At least one (in this embodiment, one) air inlet 58*a* is formed at the front portion of the lower case 58 forming the inner space Si to open in a forward direction. Four air outlets 58*b* respectively corresponding to the four branch passages 14*a* are formed at the rear portion of the lower case 58 forming a part of the inner space S2 to open in a downward direction such that the four air outlets 58*b* are aligned in the rightward and leftward direction. Annular fitting protrusions 62 are formed at the peripheral edges of the upstream end portions of the four air outlets 58*b*, respectively, such that the fitting protrusions 62 protrude into the inner space S2 of the air cleaner box 54. The air-intake ducts 50 are fitted to the fitting protrusions 62, respectively. A portion (front portion) 60*a* of the upper case 60 which is opposite to the air cleaner element 56 is tilted such that its inner surface increases in height toward a center portion 60*b*. A portion (rear portion) 60*c* of the upper case 60 which is opposite to the air outlets 58*b* is formed such that its inner surface is lower than the inner surface of the center portion 60*b*. Such a structure allows the air cleaned by the air cleaner element 56 to be guided smoothly to the respective four air outlets 58*b* along the inner surface of the upper case 60. Recesses 64 having through-holes 64*a* are formed at the rear portion 60*c* of the upper case 60. Tubular fuel guides 64*b* are formed at the peripheral portions of the through-holes 64*a*, respectively, such that the fuel guides 64*b* protrude into the inner space S2 of the air cleaner box 54. A plurality of (in this embodiment, six) fastening portions 66 are formed inside at least either the lower case 58 or the upper case 60 (in this embodiment, the lower case 58) to fasten the air-intake ducts 50, respectively.

The tip end portions of the upstream injectors 68 are accommodated into the recesses 64 of the upper case 60, respectively. The upstream injectors 68 are configured to inject the fuel into the air-intake passage 14 in the inner space S2 of the air cleaner box 54. Injection ports 68*a* formed at the tip end portions of the upstream injectors 68 are fitted to the through-holes 64*a* of the recesses 64, respectively. The injection ports 68*a* communicate with the air-intake passage 14 (inner space S2) through the fuel guides 64*b*, respectively. Therefore, in the air-intake passage 14 (inner space S2), the air cleaned by the air cleaner element 56 is mixed with the fuel injected through the injection ports 68*a*, and the resulting air-fuel mixture is distributed to the four air-intake passages 14*a* through the air-intake ducts 50 provided at the four air outlets 58*b*, respectively.

[Configuration of Throttle Device]

As shown in FIG. 2, the throttle device 52 is configured to control the amount of air-fuel mixture supplied to the combustion chambers (not shown), and includes throttle bodies 70 constituting a part of the air-intake structure 15, downstream throttle valves 72 for controlling the flow rate of the air-fuel mixture inside the throttle body 70, and upstream throttle valves 74 for controlling the flow rate of the air-fuel mixture inside the throttle body 70.

The throttle bodies 70 are tubular members configured to guide the air-fuel mixture supplied from the air cleaner 48 through the air-intake ducts 50, to the combustion chambers. In this embodiment, the four throttle bodies 70 are aligned in the rightward and leftward direction. Each throttle body 70 includes a downstream tubular portion 76 coupled to the intake port 46 and an upstream tubular portion 78 coupled to the associated air-intake duct 50. The upstream tubular portion 78 has a larger inner diameter than the downstream tubular portion 76. The downstream tubular portion 76 is provided on its outer surface with a recess 80 having a through-hole 80*a*. The downstream throttle valve 72 is provided inside the downstream tubular portion 76. The upstream throttle valve 74 is provided inside the upstream tubular portion 78. The tip end portion of the downstream injector 82 is accommodated into the recess 80.

The downstream throttle valve 72 is a main throttle valve configured to be directly operated by the driver. An accelerator grip (not shown) is coupled to the downstream throttle valve 72 via a throttle wire (not shown). According to the driver's operation amount of the accelerator grip, the opening degree of the downstream throttle valve 72 is controlled. In contrast, the upstream throttle valve 74 is a sub-throttle valve actuated in an auxiliary manner by a control unit (ECU) or the like. A drive motor (not shown) is coupled to the upstream throttle valve 74. The control unit (ECU) drives the drive motor to actuate the upstream throttle valve 74, thereby controlling the opening degree of the upstream throttle valve 74. Therefore, even when the driver operates the accelerator grip rapidly to change the opening degree of the downstream throttle valve 72 rapidly, the upstream throttle valve 74 operates to change the flow rate of the air smoothly, thereby enabling the engine speed of the engine E to change smoothly.

The downstream injector 82 is configured to inject the fuel to the air-intake passage 14 in an inner space S3 of the throttle body 70. An injection port 82*a* formed at the tip end portion of the downstream injector 82 is fitted to the through-hole 80*a* of the recess 80 and communicates with the air intake passage 14 (inner space S3). Therefore, in each branch passage 14*a* (inner space S3) of the air-intake passage 14, the air or air-fuel mixture delivered from the air cleaner 48 through the air-intake duct 50 is mixed with the fuel injected through the injection port 82*a*, and the resulting air-fuel mixture is supplied to the combustion chamber through the intake port 46. The fuel injection amount of the upstream injector 68 and the fuel injection amount of the downstream injector 82 are controlled according to a load state of the engine E. For example, in a state where the engine E is under a low-load state, i.e., running at a low engine speed, only the downstream injector 82 injects the fuel, while in a state where the engine E is under a high-load state, i.e., running at a high engine speed, both the upstream injector 68 and the downstream injector 82 inject the fuel.

[Configuration of Air-Intake Duct Structure]

Figure 4:
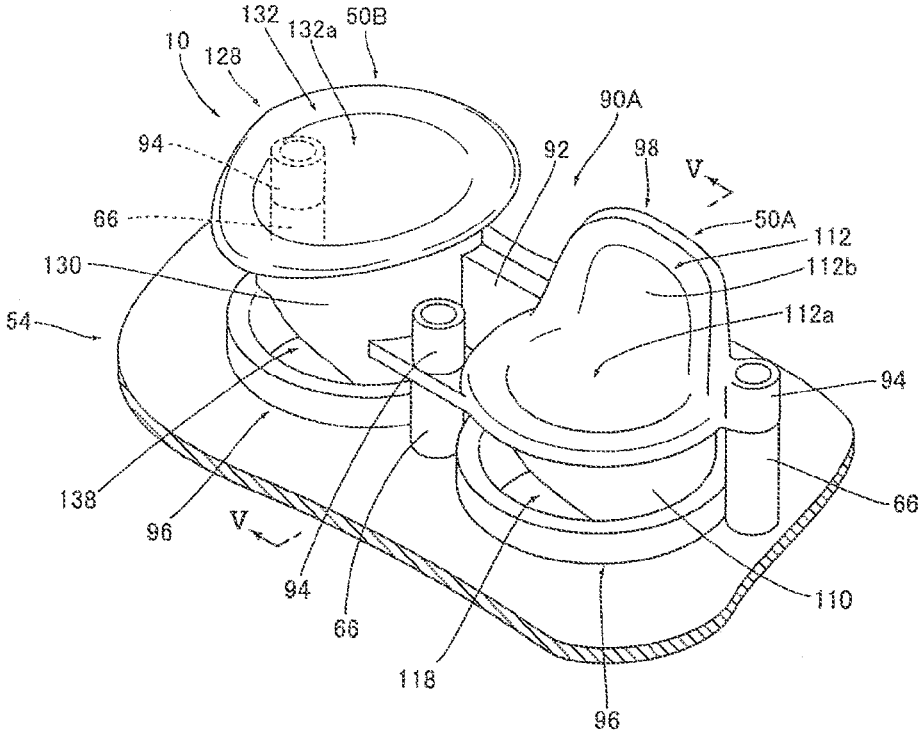
FIG. 4 is a perspective view showing a part of the air-intake duct structure including air-intake ducts according to Embodiment 1.
Figure 5:
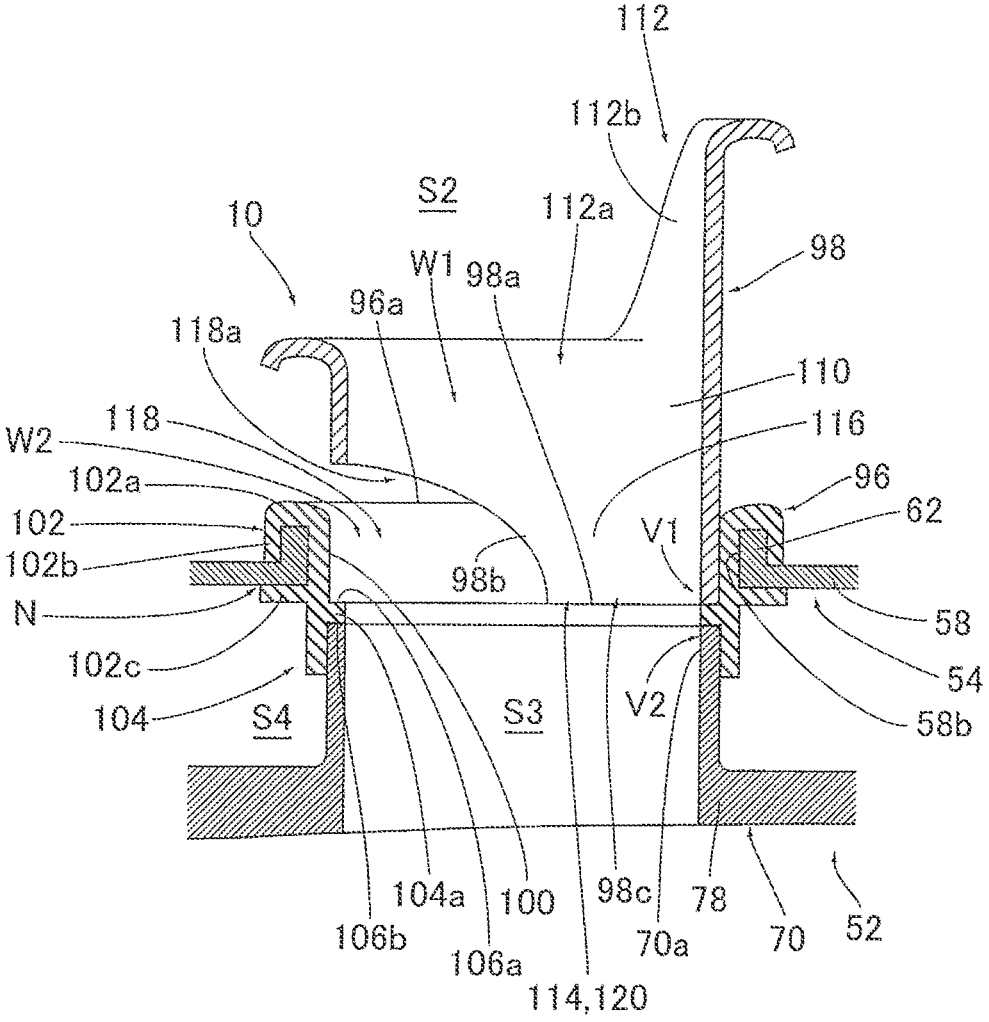
FIG. 5 is a cross-sectional view taken along line V-V of FIG. 4.
Figure 6:
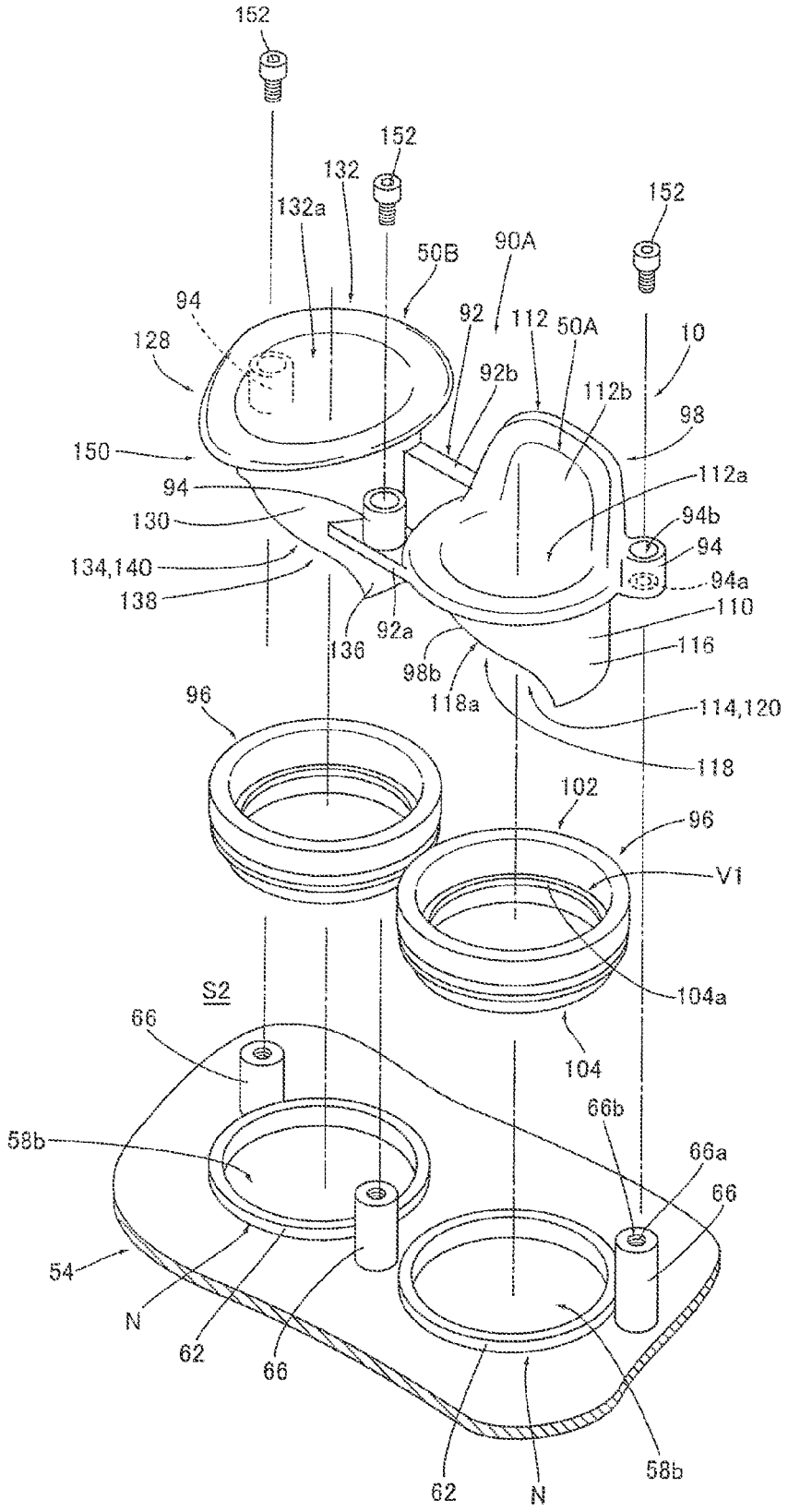
FIG. 6 is an exploded perspective view showing a part of an air-intake duct structure including air-intake ducts according to Embodiment 1.

FIG. 3 is a cross-sectional view showing the air-intake structure 15 including the air-intake duct structure 10. FIG. 4 is a perspective view showing a part of the air-intake duct structure 10 including the air-intake ducts 50. FIG. 5 is a cross-sectional view showing a part of the air-intake duct structure 10. FIG. 6 is an exploded perspective view showing a part of the air-intake duct structure 10.

As shown in FIGS. 2 and 3, the air-intake duct structure 10 constitutes the air-intake structure 15, and includes the air-intake ducts 50 (air-intake ducts 50A, 50B, 50C and 50D). FIGS. 3, 4 and 6 show the configuration of the air-intake duct structure 10 as viewed from the front. The right and left in these drawings are reverse of the right and left from the perspective of the driver straddling the motorcycle 12.

Referring to FIG. 3, the air-intake duct structure 10 is provided between the air outlets 58*b* of the air cleaner box 54 and air inlets 70*a* (upstream opening portions of the upstream tubular portions 78) of the throttle bodies 70 and is configured to guide the air cleaned by the air cleaner 48 to the throttle device 52. The air-intake duct structure 10 includes the four fitting protrusions 62 formed at the peripheral edges of the four air outlets 58*b* of the air cleaner box 54, respectively, the four air-intake ducts 50A, 50B, 50C and 50D mounted to the four air outlets 58*b*, respectively, and six fastening portions 66 formed inside the lower case 58. In FIG. 3, four fastening portions 66 are depicted and the remaining two fastening portions 66 are positioned forward relative to the cross-section and are invisible.

As shown in FIGS. 5 and 6, the fitting protrusion 62 is an annular protrusion formed at a peripheral edge N of the upstream end portion of the air outlet 58*b* to protrude into the inner space S2 of the air cleaner box 54. The peripheral edge N of the air outlet 58*b*, including the fitting protrusion 62 has a cross-sectional shape of a substantially L-shape. The axial length of the inner peripheral surface of the air outlet 58*b* is equal to a dimension which is a sum of the thickness of the air cleaner box 54 and the height of the fitting protrusion 62. This structure allows the air outlet 58*b* to contact the associated one of the air-intake ducts 50A, 50B, 50C and 50D with a larger area.

As shown in FIG. 3, the first, second, third and fourth air-intake ducts 50A, 50B, 50C and 50D are configured such that the second air-intake duct 50B and the third air-intake duct 50C located at the center of the air cleaner box 54 are different in shape from the first air-intake duct 50A and the fourth air-intake duct 50D which are located at the right and left sides of the second air-intake duct 50B and the third air-intake duct 50C, respectively. The first air-intake duct 50A and the second air-intake duct 50B which are different in shape are coupled to each other to form a first air-intake duct unit 90A. The third air-intake duct 50C and the fourth air-intake duct 50D which are different in shape are coupled to each other to form a second air-intake duct unit 90B. Since the first air-intake duct unit 90A and the second air-intake duct 90B are configured symmetrically in the rightward and leftward direction, only the first air-intake duct unit 90A will be described hereinafter, and the description of the second air-intake duct unit 90B will be omitted.

[Configuration of Air-Intake Duct Unit]

As shown in FIGS. 4 and 6, the first air-intake duct unit 90A includes the first air-intake duct 50A, the second air-intake duct 50B, a coupling portion 92 coupling the first air-intake duct 50A to the second air-intake duct 50B, and three fastening portions 94.

As shown in FIGS. 5 and 6, the first air-intake duct 50A includes a tubular coupling member 96 which is entirely formed of an elastic rubber material (rubber, elastomer, etc) and an air guide member 98 which is entirely formed of a material (synthetic resin, metal, etc) which is other than the elastic rubber material.

Turning back to FIG. 2, the coupling member 96 is a tubular member configured to perform a coupling function for coupling in an air tight manner the air cleaner box 54 to the throttle body 70. As shown in FIG. 5, the coupling member 96 includes a tubular peripheral wall portion 100 inserted into the air outlet 58*b*, an upstream coupling portion 102 formed at the upstream end portion of the peripheral wall portion 100 and coupled in an air tight manner to the air outlet 58*b*, and a downstream coupling portion 104 formed at the downstream end portion of the peripheral wall portion 100 and coupled in an air tight manner to the air inlet 70*a* of the throttle body 70. The upstream coupling portion 102 protrudes into the inner space S2 of the air cleaner box 54, while the downstream coupling portion 104 protrudes into an outside space S4 of the air cleaner box 54.

The upstream coupling portion 102 includes a flanged upper engagement portion 102*a* extending radially outward from the upstream end portion of the peripheral wall portion 100 and configured to cover the tip end surface of the fitting protrusion 62, an annular seal portion 102*b* extending from the outer peripheral edge of the upper engagement portion 102*a* toward the inner surface of the lower case 58 and configured to contact the outer surface of the fitting protrusion 62, a flanged lower engagement portion 102*c* extending radially outward from the outer peripheral surface of the peripheral wall portion 100 and configured to contact the outer surface of the lower case 58. The peripheral edge portion N of the air outlet 58*b*, including the fitting protrusion 62, is fitted to a bag-like portion defined by the upper engagement portion 102*a*, the seal portion 102*b* and the lower engagement portion 102*c*.

The downstream coupling portion 104 includes an annular protrusion 104*a* protruding radially inward from the inner peripheral surface of the peripheral wall portion 100. A downstream end surface 98*a* of the air guide member 98 is in contact with the upstream end surface 106*a* of the protrusion 104*a*. The end surface of the air inlet 70*a* is in contact with the downstream end surface 106*b* of the protrusion 104*a*. In this embodiment, the protrusion 104*a* forms upper and lower stepped portions V1 and V2 over the entire circumference of the inner peripheral surface of the coupling member 96 (peripheral wall portion 100). The downstream end surface 98*a* of the air guide member 98 is in contact with the upstream stepped portion V1, while the end surface of the air inlet 70*a* is in contact with the downstream stepped portion V2.

Turning back to FIG. 2, the air guide member 98 is a tubular member configured to perform the air guiding function for guiding the air cleaned by the air cleaner element 56 and the fuel injected from the upstream injector 68 to the throttle device 52. The air guide member 98 is formed integrally using the material other than the elastic rubber material, such as synthetic resin, metal, etc. As shown in FIGS. 5 and 6, the air guide member 98 includes a tubular peripheral wall portion 110 formed of the material other than the elastic rubber material (in this embodiment, synthetic resin), a first air inlet 112 configured to take in the air therethrough from inside the air cleaner box 54, a first air outlet 114 configured to discharge the air therethrough toward the throttle body 70, a fitting portion 116 fitted to the coupling member 96, a second air inlet 118 (FIG. 5) which is provided to open in a direction different from the direction in which the first air inlet 112 opens and configured to take in air therethrough from inside the air cleaner box 54, and a second air outlet 120 configured to discharge the air therethrough toward the throttle body 70. The first air inlet 112, the first air outlet 114, the fitting portion 116, the second air inlet 118 and the second air outlet 120 are integral with the peripheral wall portion 110.

The first air inlet 112 includes, at the upstream end portion of the peripheral wall portion 110, an opening portion 112*a* configured to open toward the inner space S2 of the air cleaner box 54 and a rear wall 112*b* extending upward from the rear portion of the opening portion 112*a*. The opening portion 112*a* is shaped as a funnel to take in the air smoothly. The surface of the rear wall 112*b* is shaped to be smooth to guide the air to the opening portion 112*a* smoothly. As shown in FIG. 3, in the air-intake duct structure 10, the opening portion 112*a* is positioned closer to the lower case 58 than the tip end portion of the fuel guide 64*b*, while the tip end portion of the rear wall 112*b* is positioned closer to the upper case 60 than the tip end portion of the fuel guide 64*b*. Therefore, a space is ensured between the opening portion 112*a* and the tip end portion of the fuel guide 64*b*. The air and fuel flowing into the space are guided along the rear wall 112*b* and suctioned into the throttle body 70 efficiently through the opening portion 112*a*.

The second air inlet 118 is located below the first air inlet 112 and serves to take in the air flowing in a direction different from the direction in which the air flows through the first air inlet 112. The second air inlet 118 has an opening portion 118*a* extending from a region of the front portion of the peripheral wall portion 110 which is in the vicinity of the axial center, to its downstream end portion. The opening portion 118*a* has a shape formed by cutting a part of the cylindrical peripheral wall portion 110 from the downstream end portion toward its upstream side. In other words, the opening portion 118*a* is not a hole surrounded by the peripheral wall portion 110 over the entire periphery, but is formed by cutting a portion of the peripheral wall portion 110 to open toward its downstream side. A part of the downstream edge 98*b* of the air guide member 98 (peripheral wall portion 110) forms a part of the inner peripheral edge of the opening portion 118*a*. As shown in FIG. 5, in a state where the air guide member 98 is joined to the coupling member 96 to form the first air-intake duct 50A of FIGS. 4 and 6, a part of the downstream edge 98*b* of the air guide member 98 is positioned in the inner space S2 of the air cleaner box 54 to be distant from the upstream edge 96*a* of the coupling member 96, and the second air inlet 118 of a hole shape is formed between a part of the downstream edge 98*b* and the upstream edge 96*a*.

As described above, in this embodiment, since a part of the downstream edge 98*b* of the air guide member 98 and the upstream edge 96*a* of the coupling member 96 form the second air inlet 118 together, it is not necessary to form the second air inlet 118 only in one of the air guide member 98 and the coupling member 96. Thus, the structure of the air guide member 98 and the structure of the coupling member 96 can be simplified, and as a result, a manufacturing cost does not increase.

The fitting portion 116 is fitted to a portion of the inner peripheral surface of the coupling member 96 which is located upstream of the stepped portion V1. In this embodiment, the fitting portion 116 is a portion of a substantially semicylinder shape which is located at the downstream end portion of the peripheral wall portion 110. Therefore, the protruding amount of the air-intake duct 50A which protrudes into the inner space S2 of the air cleaner box 54, and the position of the first air inlet 112 are determined by the length (length in the direction in which the air-intake duct A protrudes) of the portion of the peripheral wall portion 110 which is located upstream of the fitting portion 116.

The first air outlet 114 and the second air outlet 120 share an opening portion 98*c* formed at the downstream end portion of the air guide member 98 (peripheral wall portion 110). The air and fuel taken in through the first air inlet 112 are discharged through the opening portion 98*c* (first air outlet 114), while the air and the fuel taken in through the second air inlet 118 are discharged through the opening portion 98*c* (second air outlet 120). In other words, inside the peripheral wall portion 110, there are a main passage W1 from the first air inlet 112 to the opening portion 98*c* and a sub-passage W2 from the second air inlet 118 to the opening portion 98*c*

(second air outlet 120). The main passage W1 and the sub-passage W2 are joined to each other inside the peripheral wall portion 110.

As shown in FIG. 6, the opening portion 118*a* of the peripheral wall portion 110 is formed by cutting a portion of the peripheral wall portion 110 and a part of the opening portion 118*a* opens toward its downstream side. The second air inlet 118, the first air outlet 114 and the second air outlet 120 are continuous. As shown in FIG. 5, in the first air-intake duct 50A of FIGS. 4 and 6 since the second air inlet 118, the first air outlet 114 and the second air outlet 120 are defined by the coupling member 96, the air and the fuel flowing through the main passage W1 and the sub-passage W2 can be discharged through the air outlets 114 and 120 smoothly. To enable the main passage W1 of a larger passage length to rectify the flow effectively, it is desirable to set the passage cross-sectional area of the sub-passage W2 smaller than the passage cross-sectional area of the main passage W1.

As shown in FIGS. 4 and 6, the second air-intake duct 50B includes the tubular coupling member 96 which is entirely formed of an elastic rubber material (rubber, elastomer, etc) and an air guide member 128 which is entirely formed of a material (synthetic resin, metal, etc) which is other than the elastic rubber material. Since the constituents of the coupling member 96 of the second air-intake duct 50B are identical to those of the coupling member 96 of the first air-intake duct 50A, they will not be described, respectively.

Turning back to FIG. 2, the air guide member 128 is a tubular member configured to perform the air guiding function like the air guide member 98. As shown in FIG. 6, the air guide member 128 includes a tubular peripheral wall portion 130 formed of the material other than the elastic rubber material, such as synthetic resin, metal, etc. In this embodiment, the air guide member 128 is formed of synthetic resin. A first air inlet 132 configured to take in the air therethrough from inside the air cleaner box 54, a first air outlet 134 configured to discharge the air therethrough toward the throttle body 70 (FIG. 3), a fitting portion 136 fitted to the coupling member 96, a second air inlet 138 which is oriented to open in a direction different from the direction in which the first air inlet 132 opens and configured to take in the air therethrough from inside the air cleaner box 54, and a second air outlet 140 configured to discharge the air therethrough toward the throttle body 70, are integral with the peripheral wall portion 130.

The first air inlet 132 of the air guide member 128 is different in structure from the first air inlet 112 of the first air-intake duct 50A. The first air outlet 134, the fitting portion 136, the second air inlet 138 and the second air outlet 140 of the second air-intake duct 50B are identical in structure to the first air outlet 114, the fitting portion 116, the second air inlet 118 and the second air outlet 120 of the first air-intake duct 50A. Therefore, only the structure of the first air inlet 132 will be described and the structure of other constituents will not be described repetitively.

As shown in FIG. 6, the first air inlet 132 includes, at the upstream end portion of the peripheral wall portion 130, an opening portion 132*a* formed to open toward the inner space S2 of the air cleaner box 54. The opening portion 132*a* funnels such that its front portion is lower than its rear portion. The rear portion of the opening portion 132*a* is substantially equal in height to the tip end portion of the rear wall 112*b* of the first air-intake duct 50A. In other words, as shown in FIG. 3, the rear portion of the opening portion 132*a* is closer to the upper case 60 than the tip end portion of the fuel guide 64*b*. Therefore, the tip end portion of the fuel guide 64*b* is disposed below the opening portion 132*a* inside the peripheral wall portion 130, and the fuel injected through the tip end portion of the fuel guide 64*b* is discharged efficiently from the first air outlet 134 through the main passage W1.

Thus, in this embodiment, since the protruding amount of the second air-intake duct 50B (peripheral wall portion 130) which protrudes into the inner space S2 of the air cleaner box 54 is set larger than the protruding amount of the first air-intake duct 50A (peripheral wall portion 110) which protrudes into the inner space S2 of the air cleaner box 54, the air-intake properties of the first and second air-intake ducts 50A and 50B are compensated as a whole in the air-intake duct structure 10, and an engine torque is stabilized.

As shown in FIG. 6, the air guide member 98 of the first air-intake duct 50A is coupled to the air guide member 128 of the second air-intake duct 50B via the coupling portion 92 to form an air guiding unit 150 as one component. The coupling portion 92 has a cross-section of a substantially L-shape and includes a center coupling portion 92*a* and a rear coupling portion 92*b*. One fastening portion 94 is formed integrally with the coupling portion 92*a* located at the center. The remaining two fastening portions 94 are formed integrally with the right and left end portions of the air guide unit 150. The fastening portions 66 of the lower case 58 have holes 66*b* provided with female threads 66*a* on their inner peripheral surfaces. The fastening portions 94 of the air guide unit 150 have holes 94*b* provided with bolt engagement portions 94*a* on their bottom portions, respectively. Each fastening portion 66 of the lower case 58 is joined to the associated fastening portion 94 of the air guide unit 150 by inserting and threading a fastener bolt 152 into these fastening portions 66 and 94.

[Manufacturing Method of Air-Intake Duct Structure And Advantages]

The manufacturing method of the air-intake duct structure 10 will be described with reference to FIGS. 5 and 6. Initially, the upstream coupling portions 102 of the coupling members 96 are fitted to the air outlets 58*b* of the air cleaner box 54, and the downstream coupling portions 104 of the coupling members 96 are fitted to the air inlets 70*a* of the throttle bodies 70. Then, the fitting portion 116 of the air guide member 98 constituting the air guide unit 150 and the fitting portion 136 of the air guide member 128 constituting the air guide unit 150 are fitted to the inner peripheral surfaces of the coupling members 96, respectively, and the fastening portions 94 of the air guide unit 150 are fastened to the fastening portions 66 formed inside the lower case 58, using the fastener bolts 152, respectively. Then, the upper case 60 is joined to the lower case 58, thereby completing the air cleaner box 54.

In this embodiment, the coupling members 96, and the air guide members 98 and 128 are manufactured individually as separate members. Therefore, the entire coupling member 96 is formed of the elastic rubber material and the entire or a part of the air guide members 98 and 128 can be manufactured to have a small wall thickness using synthetic resin, metal, etc, which is lightweight and makes it possible to maintain the shape of the air guide members 98 and 128, as compared to the elastic rubber material.

Since one of the air guide members 98 and 128 constituting the air guide unit 150 is reinforced by the other, the shape of the air guide members 98 and 128 can be maintained surely. Since the air guide unit 150 including the two air guide members 98 and 128 can be fastened as one component to the air cleaner box 54, great fastening stiffness can be attained with fewer fastener bolts 152 and the air guide members 98 and 128 can be fastened to the air cleaner box 54 more efficiently than a case where the air guide members 98 and 128 are individually fastened to the air cleaner box 54.

Furthermore, since the air-intake duct 50 is assembled by fitting the fitting portion 116 of the air guide member 98 and the fitting portion 136 of the air guide member 128 to the coupling members 96, respectively, only the air guide members 98 and 128 can be changed by pulling out the air guide members 98 and 128 from the coupling members 96.

(Embodiment 2)

Figure 7:
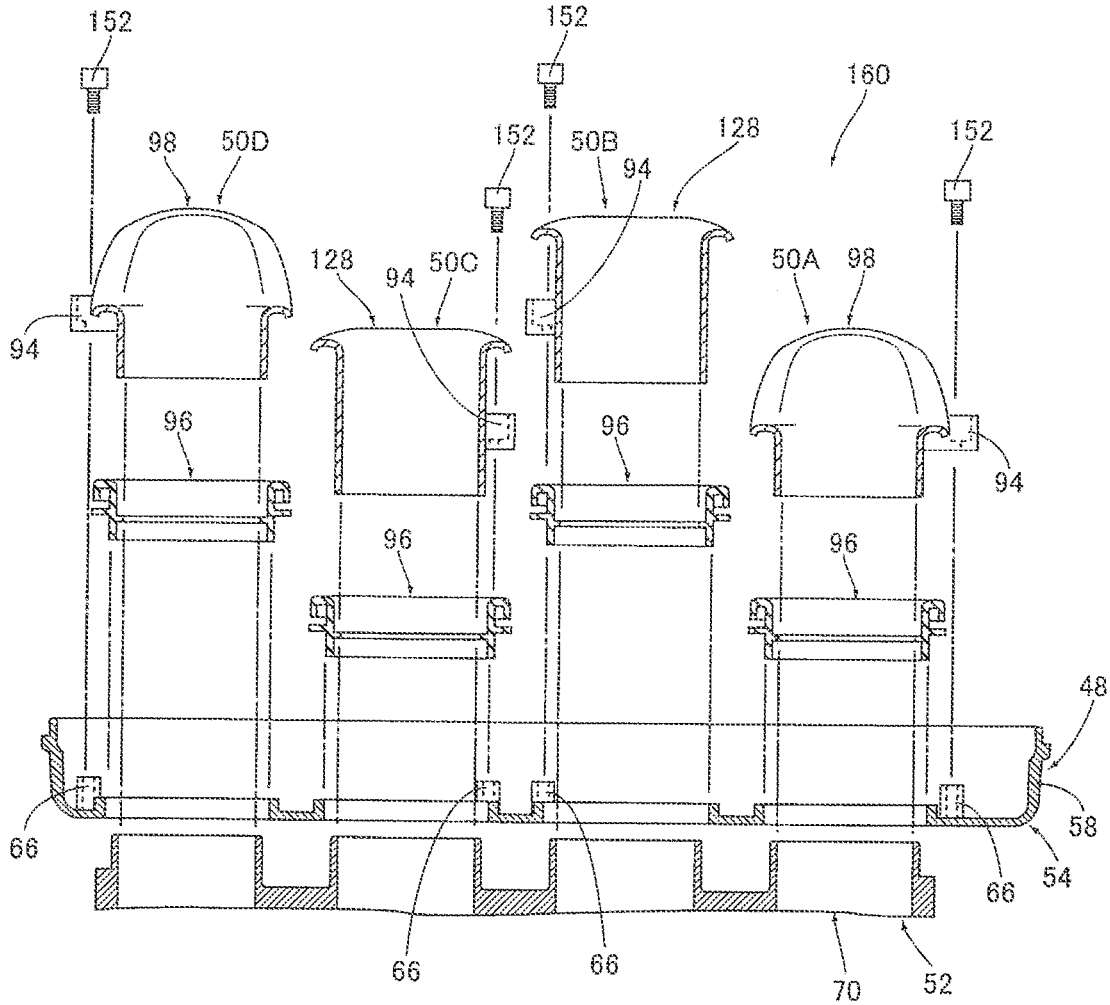
FIG. 7 is an exploded cross-sectional view showing a part of an air-intake duct structure including air-intake ducts according to Embodiment 2.

FIG. 7 is an exploded perspective view showing a part of an air-intake duct structure 160 including air-intake ducts 50 according to Embodiment 2. Although in the air-intake duct structure 10 according to Embodiment 1, the two air guide members 98 and 128 are coupled to each other to form one air guide unit 150, the four air guide members 98 and 128 may be coupled to each other or may be formed independently of each other.

In the air-intake duct structure 160 of Embodiment 2, the four air guide members 98 and 128 are formed independently of each other and one fastening portion 94 is provided for each of the four air guide members 98 and 128.

(Embodiment 3)

Figure 8:
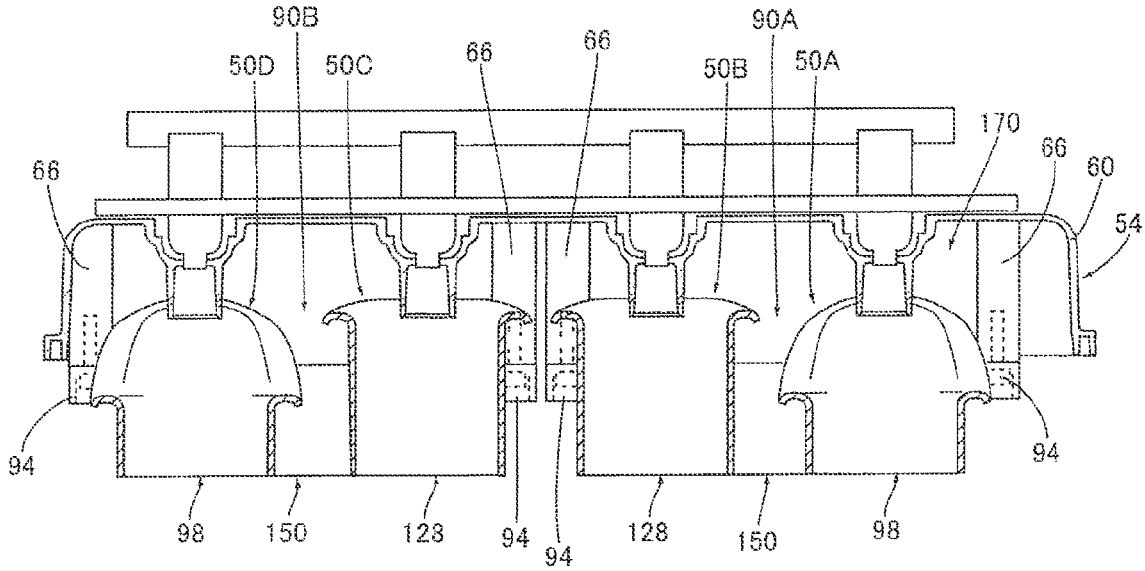
FIG. 8 is a cross-sectional view showing a part of an air-intake duct structure including air-intake ducts according to Embodiment 3.

FIG. 8 is a cross-sectional view showing a part of an air-intake duct structure 170 including air-intake ducts 50 according to Embodiment 3. Although in the air-intake duct structure 10 of Embodiment 1, all of the four air guide members 98 and 128 are fastened to the lower case 58, a part or all of them may be fastened to the upper case 60.

In the air-intake duct structure 170 of Embodiment 3, all of the four air guide members 98 and 128 are fastened to the upper case 60, and the fastening portions 66 are formed inside the upper case 60.

(Embodiment 4)

Figure 9:
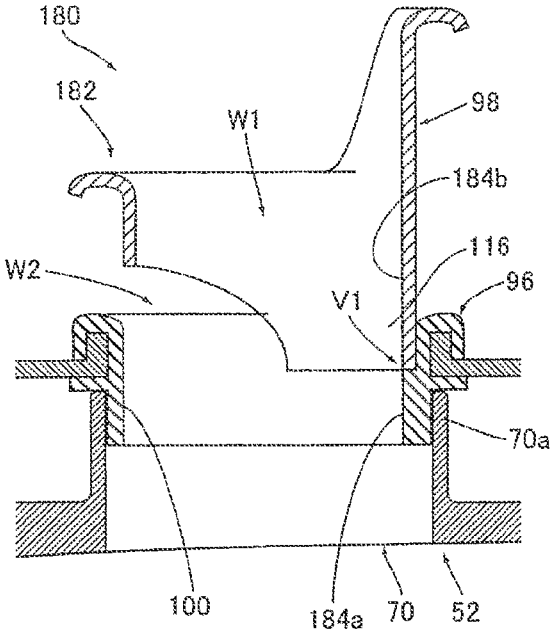
FIG. 9 is a cross-sectional view showing a part of an air-intake duct structure including air-intake ducts according to Embodiment 4.

FIG. 9 is a cross-sectional view showing a part of an air-intake duct structure 180 including air-intake ducts 182 according to Embodiment 4. Although in the air-intake duct structure 10 of Embodiment 1, the annular protrusion 104*a* forms the stepped portion V1 extending over the entire circumference of the inner peripheral surface of the coupling member 96, the stepped portion V1 may be formed only a part of the entire circumference of the inner peripheral surface of the coupling member 96.

In the air-intake duct structure 180 of Embodiment 4, the stepped portion V1 may be formed on only a part (rear portion) of the entire circumference of the inner peripheral surface of the coupling member 96 such that the stepped portion V1 has a height equal to the thickness of the air guide member 98, and the fitting portion 116 is fitted to a portion of the inner peripheral surface which is located upstream of the stepped portion V1. In this structure, a portion 184*a* of the inner peripheral surface of the coupling member 96 which is located downstream of the stepped portion V1 is continuous with an inner surface 184*b* of the air guide member 98 without a level difference and there is no stepped portion V1 in the sub-passage W2. This prevents the air flow from being disordered by the level difference.

(Embodiment 5)

Figure 10:
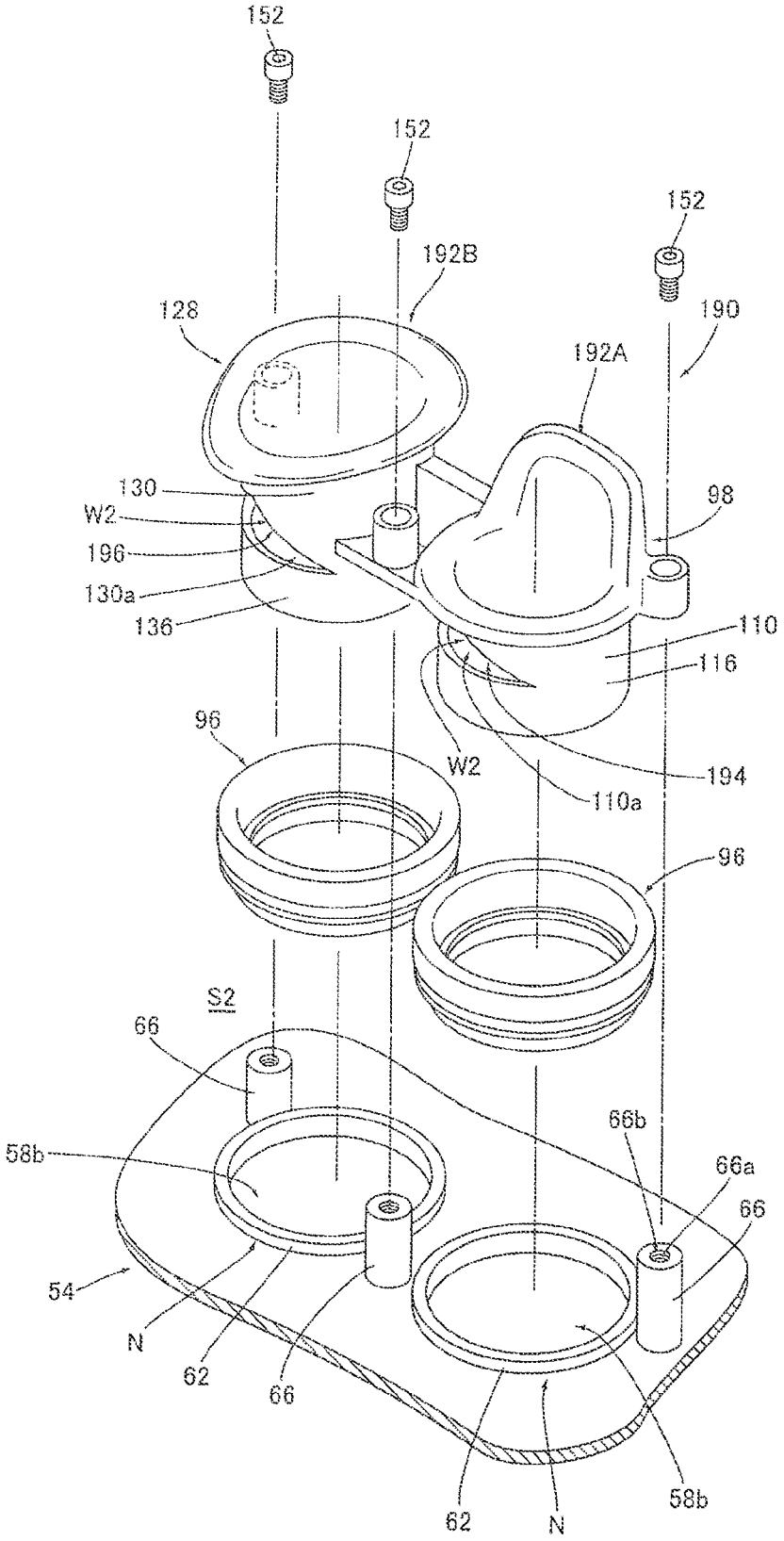
FIG. 10 is an exploded perspective view showing a part of an air-intake duct structure including air-intake ducts according to Embodiment 5.

FIG. 10 is an exploded perspective view showing a part of an air-intake duct structure 190 including air-intake ducts 192A and 192B according to Embodiment 5. In the air-intake duct structure 10 of Embodiment 1, a part of the downstream edge 98*b* of the air guide member 98 and the upstream edge 96*a* of the coupling member 96 form the second air inlet 118 together, while in the air-intake duct structure 190 of Embodiment 5, a hole 110*a* is formed on the peripheral wall portion 110 of the air guide member 98 and a hole 130*a* is formed on the peripheral wall portion 130 of the air guide member 128, and the holes 110*a* and 130*a* are used as second air inlets 194 and 196, respectively. Thus, in Embodiment 5, the opening areas of the second air inlets 194 and 196 can be determined accurately so that the flow rate of the air flowing through the sub-passage W2 can be made invariable.

(Embodiment 6)

Figure 11:
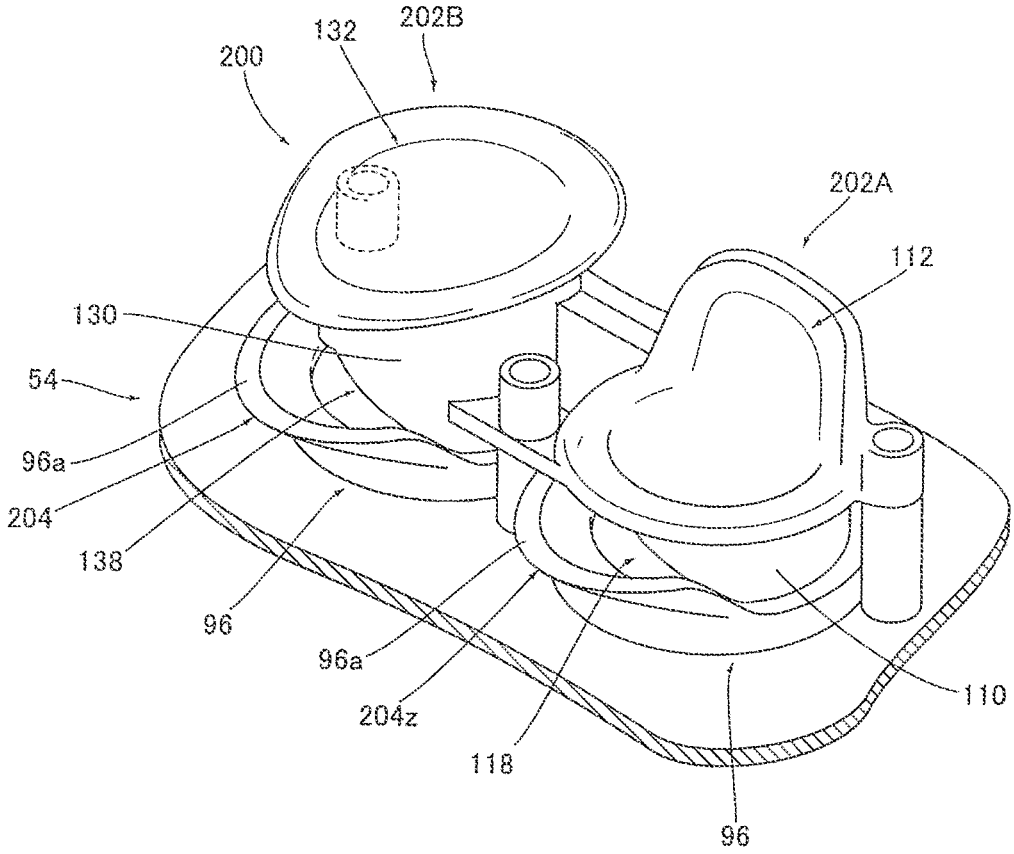
FIG. 11 is a perspective view showing a part of an air-intake duct structure including air-intake ducts according to Embodiment 6.

FIG. 11 is a perspective view showing a part of an air-intake duct structure 200 (air-intake ducts 202A and 202B) according to Embodiment 6. Funnel-shaped air guide portions 204 are formed at upstream edges 96*a* of the coupling members 96 constituting the second air inlets 118 and 138, respectively. Therefore, in Embodiment 6, the air guide portions 204 enable the air to be guided from the air cleaner box 54 efficiently to the second air inlets 118 and 138, respectively.

(Embodiment 7)

Figure 12:
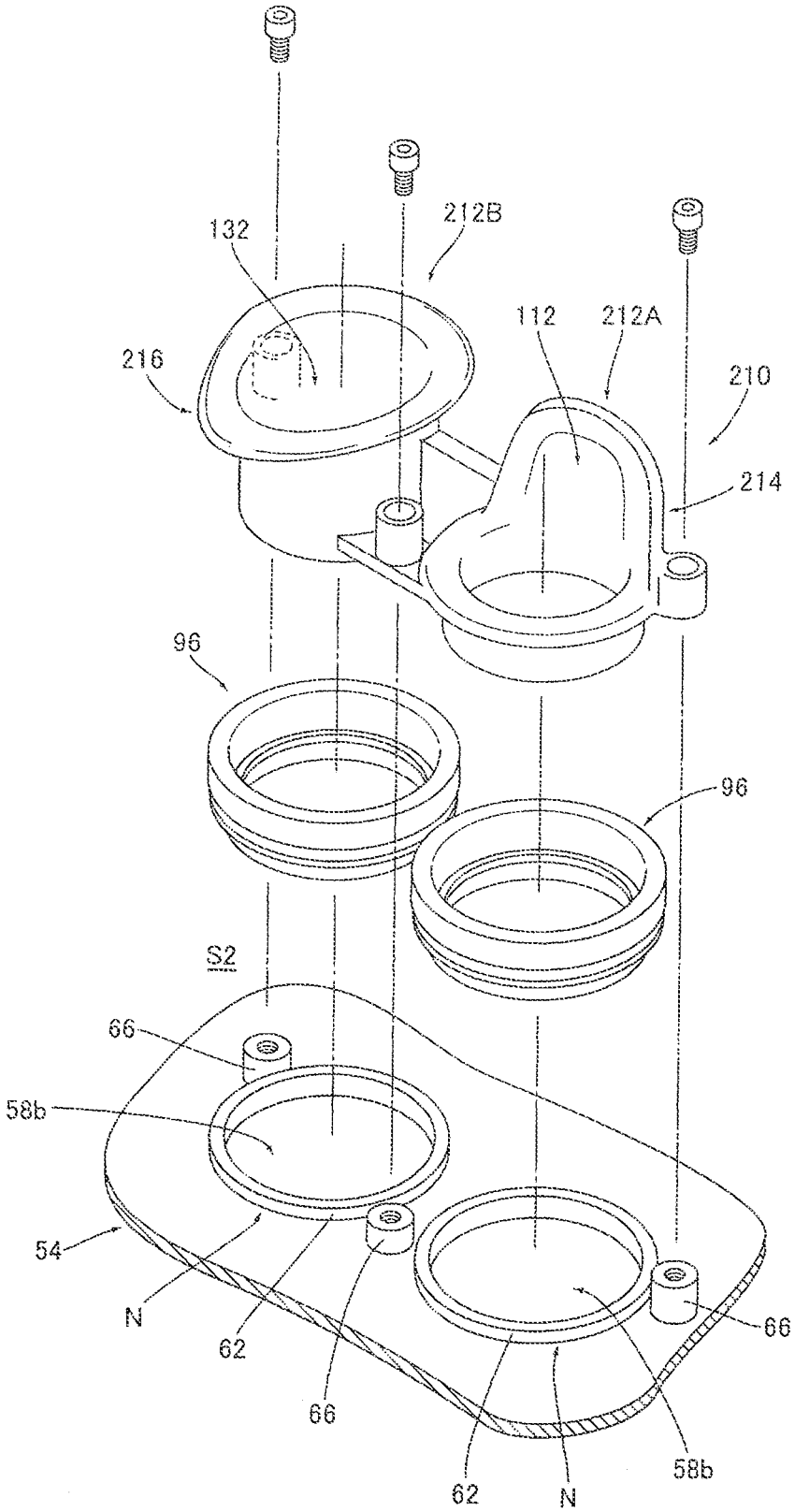
FIG. 12 is an exploded perspective view showing a part of an air-intake duct structure including air-intake ducts according to Embodiment 7.

FIG. 12 is an exploded perspective view showing a part of an air-intake duct structure 210 including air-intake ducts 212A and 212B according to Embodiment 7. In the above embodiments, the air is taken in from inside the air cleaner box 54 through the second air inlets 118 and 138, whereas in the air-intake duct structure 210 according to Embodiment 7, the second air inlets 118 and 138 are not provided but the air is taken in from inside the air cleaner box 54 only through the first air inlets 112 and 132. In this embodiment, a design change is easily accomplished in such a manner that other guide members 214 and 216 may be fitted to the coupling members 96 used in Embodiments 1 to 5.

As should be appreciated from the above, the air-intake duct and air-intake structure of the present invention can perform a coupling function and an air guiding function in a well-balanced manner, can reduce weight to improve fuel efficiency, can improve design flexibility, can be manufactured without a cost increase, can easily control an air-intake performance of an air-intake passage, and are widely applicable to vehicles such as motorcycles and personal watercraft (PWC) which can achieve these advantages.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An air-intake duct configured to guide air in a first space defined by an air cleaner box constituting an air cleaner to a second space defined by a throttle body constituting a throttle device, comprising:

a tubular coupling member disposed in a space between the first space and the second space to couple an air outlet of the air cleaner box to an air inlet of the throttle body; and an air guide member provided separately from the coupling member and disposed in the first space to guide the air flowing through inside of the air cleaner to the coupling member, wherein the coupling member has a stepped portion on at least a portion of an inner peripheral surface thereof, at least a portion of a downstream end surface of the air guide member being engageable with the stepped portion;

a downstream end portion of the air guide member is fitted to a portion of the inner peripheral surface of the coupling member which is located upstream of the stepped portion; and a portion of the inner peripheral surface of the coupling member which is located downstream of the stepped portion is continuous with an inner surface of the air guide member without a level difference.

2. An air-intake structure provided between a plurality of air outlets of an air cleaner box constituting an air cleaner and a plurality of air inlets of a throttle body constituting a throttle device and including an air-intake duct structure configured to guide air cleaned by the air cleaner to the throttle device, the air-intake duct structure comprising:

a plurality of tubular coupling members including upstream coupling portions coupled in an air tight manner to the air outlets, respectively, and downstream coupling portions coupled in an air tight manner to the air inlets, respectively, the tubular coupling members being entirely formed of an elastic rubber material;

a plurality of air guide members including first air inlets configured to take in the air therethrough from inside of the air cleaner box, first air outlets configured to discharge the air therethrough toward the throttle body, and fitting portions fitted to the coupling members, respectively;

a coupling portion for coupling a plurality of air guide members to each other to constitute an air guide unit; and at least one fastening member configured to fasten the air guide unit to the air cleaner box;

wherein a plurality of injectors having injection ports for injecting a fuel are provided inside of the air cleaner box to correspond to the plurality of air guide members, respectively; and the first air inlets are disposed to face the injection ports, respectively.

* * * * *